US005676707A

United States Patent [19]

Kuwabara et al.

[11] Patent Number: 5,676,707

[45] Date of Patent: Oct. 14, 1997

[54] LEATHER COLORING PROCESS COMPRISING JETTING INK ONTO A TREATED LEATHER

[75] Inventors: Nobuyuki Kuwabara, Kawasaki; Miyuki Fujita, Tokyo, both of Japan

[73] Assignee: Canon Kabushiki Kaisha, Tokyo, Japan

[21] Appl. No.: 711,003

[22] Filed: Sep. 11, 1996

Related U.S. Application Data

[63] Continuation of Ser. No. 421,856, Apr. 14, 1995, abandoned.

[30] Foreign Application Priority Data

Apr. 15, 1994 [JP] Japan ..... 6-77015
Mar. 22, 1995 [JP] Japan ..... 7-62606

[51] Int. Cl.[6] ..... D06P 3/32; D06P 5/00; B14J 2/01

[52] U.S. Cl. ..... 8/436; 8/499; 8/94.1 R; 8/916; 8/930; 347/101

[58] Field of Search ..... 8/404, 436, 499, 8/94.1 R, 115.51, 115.6, 916, 930; 427/389, 412; 428/475; 347/101

[56] References Cited

U.S. PATENT DOCUMENTS

| | | | |
|---|---|---|---|
| 1,985,675 | 1/1934 | Blatz | 8/436 |
| 3,897,204 | 7/1975 | Mizuma et al. | 8/62 |
| 4,000,958 | 1/1977 | Hirooka et al. | 8/436 |
| 4,718,918 | 1/1988 | Heller et al. | 8/436 |
| 4,785,313 | 11/1988 | Higuma et al. | 346/135.1 |
| 4,892,556 | 1/1990 | Schulzen et al. | 8/436 |
| 4,908,239 | 3/1990 | Lach et al. | 8/94.1 R |
| 5,306,435 | 4/1994 | Ishikawa et al. | 8/436 |
| 5,411,556 | 5/1995 | Dix et al. | 8/437 |

FOREIGN PATENT DOCUMENTS

| | | | |
|---|---|---|---|
| 757932 | 5/1967 | Canada . | |
| 212655 | 3/1987 | European Pat. Off. . | |
| 0226108 | 6/1987 | European Pat. Off. | C14C 11/00 |
| 0513372 | 11/1992 | European Pat. Off. | D06P 5/00 |
| 2078722 | 11/1971 | France | B41M 5/00 |
| 2108990 | 5/1972 | France . | |
| 3127598 | 3/1982 | Germany . | |
| 3523269 | 1/1986 | Germany | B41M 5/00 |
| 3543495 | 6/1986 | Germany | D06P 5/00 |
| 51-9701 | 1/1976 | Japan . | |
| 53-35196 | 6/1978 | Japan . | |
| 2-300377 | 12/1990 | Japan . | |
| 3-113073 | 5/1991 | Japan . | |
| 983908 | 2/1965 | United Kingdom . | |
| 1463072 | 6/1974 | United Kingdom . | |

OTHER PUBLICATIONS

Patent Abstracts of Japan, vol. 14, No. 227 (C–718) [4170], May 15, 1990 & JP–A–02 053976 (Seiren Co Ltd.), Feb. 22, 1990.

*Primary Examiner*—Paul Lieberman
*Assistant Examiner*—Caroline L. Dusheck
*Attorney, Agent, or Firm*—Fitzpatrick, Cella, Harper & Scinto

[57] ABSTRACT

Provided is a leather treatment process for leather coloring, carried out on a leather to be colored with a liquid ink, the process comprises the steps of, imparting to the coloring surface of the leather a resin soluble in the liquid ink and imparting to the coloring surface an aggregate of particles with a functional group having an affinity for the liquid ink.

10 Claims, 7 Drawing Sheets

LEATHER COLORING PROCESS COMPRISING JETTING INK ONTO A TREATED LEATHER

This application is a continuation of application Ser. No. 08/421,856 filed Apr. 14, 1995, now abandoned.

BACKGROUND OF THE INVENTION

1. Field of the Invention

This invention relates to a coloring process such as dyeing or coating performed on leather, and more particularly to improvements of a leather treatment process for leather coloring and a leather coloring process, which enable highly precise and simple formation of images with multi-colors and light and shade. This invention also relates to a leather coloring process that may cause no deterioration of color images thereby formed, even when mechanical external force such as bending or friction is applied to leather itself after coloring. It still also relates to a leather article including purses and bags obtained by processing leathers after the leather coloring.

2. Related Background Art

In the present specification, "leather", which particularly refers to natural leather, is obtained by unhairing raw hide or skin stripped from animals, followed by tanning. Of these processes, those for obtaining raw hide or skin and further tanning it are called a beamhouse process and a tanning process, which are industrially carried out through the following steps. First, green hide or skin obtained by skinning animals is subjected to the steps of soaking, fleshing, unhairing-liming, splitting, scudding, reliming, and deliming-bating (the beamhouse process), followed by tanning by the use of a tanning agent of various types such as chromium compounds and vegetable tannin in order to impart softness and thermal resistance to the hide or skin (the tanning process). A fur is obtained by treatment up to tanning without unhairing. These processes are usually further followed by the steps of dyeing, fatliquoring (or stuffing), conditioning, staking, stretch drying, coating and so forth (a finishing process). Having been subjected to these processes, the leather or fur is processed into leather articles as final products.

Under such circumstances, the coloring of leather by conventional dyeing or coating is carried out using coloring materials such as dyes and pigments. Almost all of these coloring materials are those employed from dyes and pigments hitherto used in the dyeing of textiles, and dyeing processes have been used under suitable selection according to the kind of raw hide or skin, the manner of tanning and the uses as leather articles. For example, there are processes such as dip dyeing, textile printing and battick dyeing.

Under actual circumstances, however, since the leather has various properties according to the type of leather, actual operation still largely depends on experience. Even when the leather is colored in monochrome, the coloring on some kinds of leathers takes a long time, requires complicated operation steps, or requires repeating the same step many times. Hence, it has been very difficult to stably and continuously produce dyed products of the same design.

In the case of pictures with light and shade or multi-color pictures and also when images are colored only in part, not only the same problems as in the above may occur, but also no dip dyeing making use of a drum can be utilized. This causes the problem that no mass production is feasible. Hitherto, screen printing or manual drawing has been employed in such cases. Hence such products have been chiefly used in arts and crafts, and yet it is difficult to say that their image quality is satisfactory in respect of minuteness and the number of colors. Accordingly, no automation has been achieved. Especially in the manual drawing, paintbrushes are used in many instances, where, under existing circumstances, the accurate management of, e.g., the quantities of dyeing solutions and the dyeing areas on leather almost can not avoid depending on experience and perception, and any mismanagement thereof causes faulty images such as bleeding.

Such a low image quality has been found to be largely caused by irregularities or large concavities remaining after finishing of leather because of follicle mouths (pores of the skin) or various wrinkles originally present in raw hide or skin. Namely, when dyed in that state, dyeing agents may conspicuously gather to that part to cause uneven densities. It is also difficult to completely eliminate irregularities or large concavities in the course of producing leather to smooth the surface. As a result, the means as stated above must be taken. Also when a similar tanning method is employed, it is possible that tanning agents and fatliquoring agents are mixed in different quantities in order to keep the handle of finished products. This is also considered to make it difficult to attain stable hues in the dyeing.

Meanwhile, with the desire to have articles with a sense of high grade in everyday living goods and ornaments, leather articles could also more highly enjoy the sense of high grade inherent in leather if articles with multi-color and highly minute images formed on the surface can be obtained, and also dyed leathers would be applicable in a wider range if it becomes possible to carry out partial dyeing on leathers with ease.

In addition, in the course up to the production of leather articles, the leather itself is subjected to a finishing step after dyeing and then stitched into articles with various forms. Thus, leathers having been dyed are moved, stretched, cut and transported, and it is quite possible that mechanical external force such as a rub or a bend is exerted to the dyed surface. In order to prevent deterioration of dyed images and taking these matters into account, one may take countermeasures such that coloring materials are used beforehand in excess to form images, or a surface protective treatment is immediately applied after dyeing has been completed. When, however, multi-color and high-density images are formed on leathers, it is not preferable to make coloring materials fix in a larger quantity than what can be received in leathers, in order to prevent bleeding or uneven color density from occurring on highly minute images. The immediate treatment for the surface protection of the dyed surface also has a difficulty in process management in view of continuous time allotment in the respective treatment steps, when like colored images are produced in a large quantity, and also brings about a difficulty in many instances in view of the deterioration of the handle of leather itself. Thus, in order to prevent such mechanical external force, care must be taken for the handling of leather itself, which, however, may cause a decrease in the efficiency at the time of production, resulting in a cost increase.

SUMMARY OF THE INVENTION

The present invention has been made taking account of the problems peculiar to leather, and objects thereof can be summarized in the following three points.

A first object of the present invention is to provide a leather treatment process for leather coloring that facilitates stable representation of highly minute images when the coloring that generically includes dyeing, coating and painting is performed on leather to form monochromatic or multiple color images.

A second object of the present invention is to provide a leather coloring process that enables efficient formation of images on the coloring leather having been subjected to such a leather treatment.

A third object of the present invention is to provide a leather article of various types, using the colored leather thus prepared that provides a high image reliability.

The invention that can achieve the first object is represented by a leather treatment process for leather coloring, carried out on a leather to be colored with a liquid ink, the process comprising the steps of;

imparting to the coloring surface of the leather a resin soluble in the liquid ink; and imparting to the coloring surface an aggregate of particles with a functional group having an affinity for the liquid ink.

In preferred embodiments of this leather treatment process for leather coloring, the resin at least is allowed to permeate into the leather from the coloring surface, and at least one of the resin and the aggregate of particles is formed into a layer on the coloring surface of the leather. In a more preferred embodiment, the resin and the aggregate of particles are each imparted in an amount of not less than 0.01 $g/m^2$ to not more than 10 $g/m^2$ of the leather.

The invention that can achieve the second and third objects will become apparent from the following description.

DESCRIPTION OF THE PREFERRED EMBODIMENTS

Figure 1:
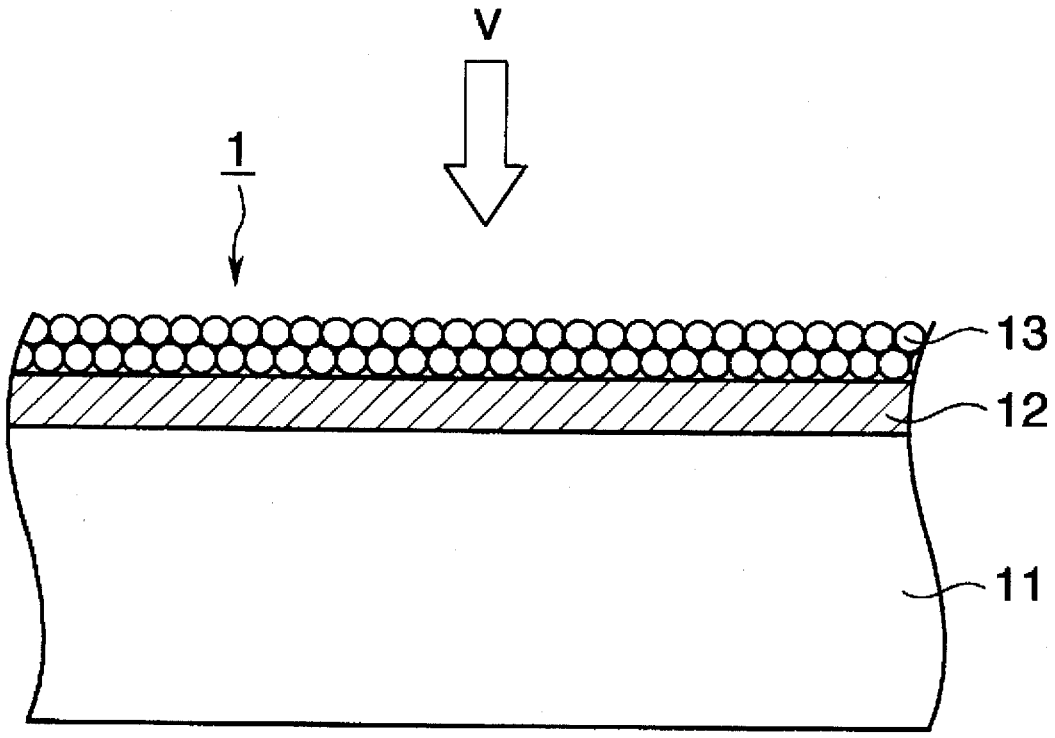
FIG. 1 is a cross section in thickness direction to diagrammatically illustrate the constitution of the coloring leather of the present invention in Example 1.

The leather treatment for leather coloring according to the present invention is applied on a leather to be colored with a liquid ink containing a coloring material. The process for such treatment basically comprises the steps of imparting to the coloring surface of the leather a resin soluble in the liquid ink, and imparting to the coloring surface an aggregate of particles with a functional group having an affinity for the liquid ink.

In the present invention, after leather coloring, the form of presence of the coloring material serving as a source of color includes any one of the form in which it has permeated into the leather, the form in which it has adhered to, or partly permeated in, the leather only at its surface layer portion or in the vicinity thereof, and the form in which it has adhered to the coloring surface of the leather. The leather coloring is carried out using a liquid ink as recited above. The liquid ink herein embraces an ink which is liquid at the time it is imparted to the leather, and may be in the form of either a liquid or a solid when not served in the leather coloring. The liquid ink may also be imparted to the leather by any method, including a method in which it is directly applied with a paintbrush or the like, a method in which it is caused to adhere to only desired areas by using a stencil for textile printing, a method in which it is caused to adhere by its jetting in the form of droplets through a jetting nozzle of a spray gun or the like, and a method in which it is caused to adhere by its jetting in the form of minute droplets through jetting nozzles of an ink-jet printing head.

Stated additionally, for simplification in the following description, the liquid ink is simply called "ink", and also the resin soluble in the liquid ink and the aggregate of particles with a functional group having an affinity for the liquid ink are called "soluble resin" and "particle aggregate", respectively. Also, since solutions prepared by dissolving dyes in water are hitherto widely used as dyeing solutions in the dyeing of leather, an ink made liquid with water may be also used in the present invention because of its easy availability. In the following description, such ink is referred to as liquid ink using water. Thus, the aforesaid solubility and affinity may be understood as those for water.

The treatment applied to the leather in the manner as described above brings about the effects as stated below. Since the soluble resin and the particle aggregate have been imparted to the coloring surface of the leather, the ink comes into contact with such coloring surface at the time of leather coloring and thereafter the ink is received on the coloring surface due to the presence of the soluble resin and also is accelerated to permeate into the leather in the direction substantially the same as its thickness direction. Concurrently therewith, the soluble resin is dissolved in the water contained in the ink. Meanwhile, on account of the presence of the particle aggregate, the ink is prevented from feathering (plane-directional spreading) on the coloring surface. Moreover, as the soluble resin is dissolved, the resin itself is decreased in viscosity or in surface tension and is easier to enter the particle aggregate through gaps between the particles thereof than before coloring. As a result, the physical fixation, namely holding of particles, between particles themselves and between particles and leather can be realized.

Because of such action, when the leather coloring is performed with a paintbrush or the like, images can be produced faithfully in details along lines thus drawn and hence peculiar touches can be represented. Also when the leather coloring is performed by jetting liquid ink droplets, stable dots can be formed once the individual ink droplets have impacted on the leather, and hence highly minute images can be represented. As for the form of presence of the soluble resin and the particle aggregate, they both may have permeated into the leather, or any one of them may be formed into a layer on the leather. Also, there is no particular order in which they are imparted. There is still also no limitation that they must be imparted by the steps respectively shared. For example, the present invention is operable also when they are imparted in the order of soluble resin/particle aggregate/soluble resin. That is, the respective steps of imparting the soluble resin and the particle aggregate may each be carried out several times.

In any case, the particle aggregate acts to control the state of permeation of ink in the thickness direction, and hence the particle aggregate may preferably be imparted in a final step so that the chance for the ink to first come into contact with the particle aggregate may become relatively large. Incidentally, the instance where the particle aggregate has permeated into the leather not only refers to the form in which the particle aggregate has entirely permeated into the leather but also includes the form in which the particle aggregate has partly entered into the leather. Namely, the former is considered able to enter the inside of the latter so long as its particles have smaller diameters than the gaps present in the structure of the leather surface. Since, however, some of such forms of presence of the soluble resin and the particle aggregate may cause a change in images represented by leather coloring, the form of their presence may be controlled so as to obtain desired images, by selecting materials and manners for imparting them which are described later.

Then, studies having been made toward much higher image quality have revealed that the soluble resin and the particle aggregate should be each imparted in an amount controlled within a certain range, i.e., each in an amount of not less than 0.01 $g/m^2$ to not more than 10 $g/m^2$. From the viewpoint of high image quality, if imparted in an amount less than 0.01 $g/m^2$, the permeation of ink that is attributable to the soluble resin, the entrance of the resin into the particle aggregate through gaps between particles, and the prevention of feathering of ink that is attributable to the particle aggregate may become not well effective. If imparted in an amount more than 10 $g/m^2$, their permeation or adhesion to the leather may be in an imperfect state, so that the soluble resin and the particle aggregate may separate later to cause a deterioration of images or may damage the handle inherent in leather.

The constitution of the leather treatment process for leather coloring according to the present invention will be specifically described below.

The soluble resin and the particle aggregate that are utilizable to constitute the present invention can be more effective when they have at least one of the features described below.

With regard to the soluble resin, it may preferably be capable of being rendered viscous upon its dissolution in ink. The soluble resin is dissolved upon contact with the ink and plays a role of retaining the particle aggregate, as previously described. Hence, the feature that the soluble resin has dissolving properties and at the same time viscosity properties effectively acts on the retention of the particles.

As examples of the resin that can exhibit such properties, it may include the following water-soluble resins, i.e., starch, casein, gelatin, maleic anhydride resin, melamine resin, urea resin, styrene-butadiene rubber, polyvinyl alcohol, polyvinyl pyrrolidone, hydroxycellulose, polyethylene oxide and acrylamide. To impart these materials onto the leather, it can be done by various methods such as a method in which any of the materials formed into an aqueous solution is sprayed by means of a spray gun, coated by means of a bar coater, a roll coater, an applicator, a doctor blade or the like, or applied by screen printing, and a method in which any of the materials formed into a film is contact bonded.

With regard to the particle aggregate, its function can be brought out so long as it can be recognized as an aggregate of particles at least at the time the ink comes into contact with it. However, in order to more fully control the state of progress of the ink, the particle aggregate should form a surface where particles are arranged along the coloring surface of the leather. This is effective as a mode of the present invention. Since the ink passes through the particle aggregate along gaps between particles, the distance at which the ink passes through in the thickness direction may be made substantially constant on the whole coloring surface, so that images stable as a whole can be formed on the leather.

In this particle aggregate, it is not essential for the individual particles to be separate from one another. They may be densely in contact with each other and two-dimensionally arranged, in the state of which a sufficient function can be brought out. Such a state of dense contact includes a state where particles are mutually in point-to-point contact, a state where individual particles have partly melt adhered to come into face-to-face contact partially, and also a state of mixture of these. Here, any particle aggregate may be formed so long as it does not form a continuous film in which no gaps are present at all.

As a means for forming the particle aggregate in the manner as described above and also furnishing the particles with the functional group having an affinity for the liquid ink, it is effective to utilize an aggregate of particles of an emulsion obtained by emulsification of liquid components of the same kind as the ink. Usual emulsion particles have polar factors. In the case of an oil-in-water type emulsion employing water as a dispersion medium, a surface active agent is adsorbed on a material insoluble in water and particles are formed so as to maintain an affinity for the water by the aid of hydrophilic groups of the surface active agent. Hence, in order to form the particle aggregate in the present invention, such an emulsion is a very effective form because the hydrophilic groups of the surface active agent can be utilized as groups for providing the affinity for the ink.

When such an emulsion is used, since it is a liquid, the dispersion medium undergoes evaporation or permeation into the leather after it has adhered to the leather. As a result, the particle aggregate is made up in the vicinity of the surface layer of the leather. However, the particles may melt adhere to one another as the quantity of the dispersion medium becomes smaller, because of the behavior common to emulsions. In order to bring out the function noted in the present invention, the melt adhesion between particles must be made not to excessively proceed to form a film, since it is a requirement to impart particles. The melt adhesion between particles usually has a temperature dependence, and a minimum filming temperature depends on the materials constituting the emulsion. Hence, the controlling of this minimum filming temperature can be a guide to the selection of materials used in the particle aggregate.

In the present invention, the minimum filming temperature of the emulsion may preferably be a temperature higher than that in the process environment of from the stage of leather treatment up to the stage of leather coloring. Herein, the temperature in the process environment from the stage of leather treatment up to the stage of leather coloring is called leather-coloring treatment temperature. Then, if the minimum filming temperature is lower than the leather-coloring treatment temperature, the emulsion particles imparted to the leather melt adhere to one another to form a film when the leather-coloring treatment or the leather coloring is carried out, which does not satisfy the constitution for the particle aggregate. Since the emulsion particles have by no means dissolved in the dispersion medium, such formation of a film brings the hydrophilic groups of the surface active agent into the state they can not act on the ink, so that it becomes difficult to derive the effect of the present invention. Also, taking account of the fact that the leather is passed through the step of drying and so forth, it is preferable for the minimum filming temperature to be set at a higher temperature. Thus, in order to stably obtain the particle aggregate, a specific minimum filming temperature may be 40° C. or above, and more preferably 80° C. or above. Since no images are disturbed if the particle aggregate is formed into a film after image formation has been completed, this temperature may be set taking account of the above leather-coloring treatment temperature.

In the foregoing, the particle aggregate has been described on an example where the emulsion is used, to which the present invention is by no means limited. It is also possible to prepare particles of a resin a part of terminal groups of which has been substituted with hydrophilic groups, and arrange the particles on, or bury them in, the leather. As to methods for forming the particle aggregate, the materials may be previously formed into a liquid when imparted to the leather, and then the same method as in the case where the soluble resin is imparted may be employed. When materials originally in the form of particles only are used, the particle aggregate may be formed on the leather by known methods.

Materials that can be used in the particle aggregate described above may include dispersions of fine inorganic particles, such as colloidal silica and alumina sol, and emulsions prepared by emulsifying a styrene/acrylate copolymer, a vinyl acetate resin, a vinyl acetate/acrylate copolymer, a vinyl acetate/baeoba copolymer, a vinyl acetate/maleate copolymer, a vinyl acetate/ethylene copolymer, a vinyl acetate/ethylene/vinyl chloride copolymer or an epoxy resin.

It is not essential for the particles of these materials to be kept perfectly spherical. They may preferably be substantially spherical. In regard to particle size, the particles may preferably have diameters ranging from 0.01 μm to 100 μm. Especially when the ink is jetted in the form of droplets, the particle diameter may preferably be smaller than the dot diameter formed on a leather by the droplets. In the dispersions or emulsions as described above, however, it is usually difficult for their particles to have a constantly uniform diameter, and the particle diameters are distributed in a certain range. Hence, the particle diameter herein referred to is defined as a particle diameter having the highest distribution percentage in such distribution. As for methods for imparting these materials to the leather, the methods previously described for imparting the soluble resin may be used.

In both the soluble resin and the particle aggregate, the materials as exemplified above may each be used alone or may be used in combination of some materials selected from usable ones. Conventionally known additives may also be optionally added, as exemplified by various types of surface active agents, antifoamers, antioxidants, ultraviolet absorbents, dispersants, viscosity modifiers, pH adjustors, antifungal agents and plasticizers.

When leather coloring is carried out on the leather having been subjected to the coloring leather treatment as described above, the leather can be well colored when the soluble resin and the particle aggregate are non-dyeable, where the soluble resin and the leather themselves are not relatively colored and the leather itself can be more efficiently colored with the ink.

The ink is a liquid ink prepared using water, as previously described. Materials that can be used as the coloring material of this ink may include various ones, as exemplified by acid dyes, metal complex dyes, basic dyes, mordant dyes, acidic mordant dyes and soluble vat dyes, which are hitherto widely used in the dyeing of leathers, and direct dyes, cationic dyes, sulfur dyes, oxidation dyes, disperse dyes and reactive dyes chiefly used for cellulose or polyester type fibers. To form the ink, these coloring materials are dissolved in water or alcohols. An ink mixed with a pigment, or mixed with a dye and a pigment, may also be used. In any case, most of these coloring materials have ionic properties. When, for example, direct dyes having anionic properties are used, the soluble resin and the particle aggregate may be anionic or nonionic materials, whereby the soluble resin and the particle aggregate cause no ionic bonding to the dye and can be made non-dyeable. In the case of pigments, they are usually insoluble in solvents, also having no dyeability to the leather itself, and can be used by themselves. When used, the pigments may be formed into emulsions making use of water as the dispersion medium, whereby the soluble resin and the particle aggregate can be made to act in the same way as described for the dye type inks.

The invention that can achieve the second object is a leather coloring process comprising imparting a liquid ink to a leather by an ink-jet printing system; the leather having been treated on its grain side and/or flesh side by the leather treatment process for leather coloring described above. As an improved mode of this invention, in the above leather coloring process, the leather on which the ink-jet coloring has been carried out is heated at a temperature not lower than the temperature at which the particle aggregate is formed into a film.

The leather treatment process for leather coloring described above may be carried out, in view of its operation, on either the grain side or the flesh side of the leather, without limitation to any one side. Hence, the side on which the leather coloring is carried out can also be either side. Using the leather having been subjected to this coloring leather treatment, it is possible to provide a leather coloring process that can achieve a higher image quality by an ink-jet printing system. According to researches made by the present inventors, the soluble resin and the particle aggregate have caused no change in properties with time after they have been imparted to the leather. Hence, it also becomes possible to carry out the leather treatment for leather coloring on plural sheets of leather together and thereafter successively set the leather sheets on an ink-jet leather coloring apparatus.

Such a leather coloring process may also include a leather coloring process in which after the leather coloring the particles constituting the particle aggregate are caused to melt adhere one another to form a film. As previously described, the melt adhesion between the particles of the particle aggregate depends on temperature, and hence the heating at a temperature higher than this temperature makes it possible to form a continuous film after the leather coloring, so as to also serve for surface protection.

Images formed after the leather coloring on the leather prepared by the leather treatment process for leather coloring according to the present invention may come off with difficulty even by mechanical external force, on account of the action of the soluble resin and particle aggregate. Meanwhile, when leathers gone through the leather coloring are transferred to a finishing process to improve a sense of beauty and strength of the leather, they are often transported or stored. If on that occasion they are exposed to a very high humidity, coloring materials may flow out of the surface of the leather to cause deterioration of images when the coloring materials are those exhibiting water-soluble properties. Even in such special cases, the images can be prevented from deterioration if the particle aggregate has been made into a film. It is also possible to prevent the properties of coloring materials from undergoing changes due to impurities floating in the air.

With regard to the heat applied at this stage, to high temperature can not be set taking account of a commonly weak thermal resistance of the collagen fibers inside the leather. The temperature the leather can resist is usually from 90° C. to 100° C. in the case of chrome leather, and from 70° C. to 80° C. at most in the case of vegetable tanned leather. The temperature set for the heating carried out at this stage is also controlled to be not higher than such temperatures. However, since the leather can resist a higher temperature against a heat instantaneously applied, it is possible to set a heating temperature at 100° C. or above so long as the heating time is set very short. The heating thus applied makes it possible to transfer the leathers gone through leather coloring, to the conventionally known finishing process through even when a storage environment becomes abnormal. The heating herein referred to is by no means limited to exposing to a given temperature environment the whole leather gone through leather coloring, and various methods can be used, as exemplified by applying hot air with a given temperature to desired leather coloring portions only, irradiating the leather with heat radiations controlled to a given temperature, bringing a metal plate controlled to a given temperature into contact with the leather, and also irradiating the leather with laser light.

The invention that can achieve the third object relates to a leather, and a leather article, on which the ink-jet coloring has been performed by the leather coloring process described above, which are produced as novel form of products. The colored leather obtained by the present invention enjoys an improved reliability of images, and various new leather articles can be produced by processing such a leather.

The invention has been described above on the modes correspondingly to the first to third objects. In addition thereto, the present invention may also generically embrace the following two modes.

One of them is a leather produced by;

coloring a coloring leather with a liquid ink; the coloring leather comprising a leather to the coloring surface of which a resin soluble in the liquid ink and an aggregate of particles with a functional group having an affinity for the liquid ink have been imparted;

and thereafter allowing the aggregate of particles to be held on the leather by virtue of the viscosity of the resin.

More specifically, the coloring leather having been subjected to the leather treatment process for leather coloring as described above is colored with the liquid ink, whereupon the soluble resin having been imparted to the leather acts to allow the additionally imparted aggregate of particles to be more strongly held on the leather itself. Thus, the leather having been operated in this way is an inventive subject matter by itself as a colored leather.

The other is a leather coloring process comprising jetting a liquid ink to a coloring leather in the form of droplets;

the coloring leather comprising a leather to the coloring surface of which a resin soluble in the liquid ink and an aggregate of particles with a functional group having an affinity for the liquid ink have been imparted, and the diameter of particles in the aggregate of particles being smaller than the diameter of dots formed by the ink droplets.

Of the coloring process carried out on the coloring leather having been subjected to the leather treatment process for leather coloring as described above, the process carried out by ink droplets is effective in order to obtain images with a higher quality level. In this process, especially when image density is increased, it is preferable to previously determine the relative relationship between the size of particles in the aggregate of particles and the size of ink droplets. The part where such a relative relationship acts is the part where the ink droplets reach the coloring surface of the coloring leather to form individual dots on the coloring surface. When the diameter of the particles is set smaller than the diameter of the ink dots at that part, the ink can readily permeate into the leather in substantially the same direction as its thickness direction.

To bring out the advantage of the invention described above, the leather coloring carried out by an ink-jet coloring system is a very effective means.

The present invention will be described below in greater detail by giving Examples. In the following, "%" is by weight, unless particularly noted.

EXAMPLE 1

Figure 4:
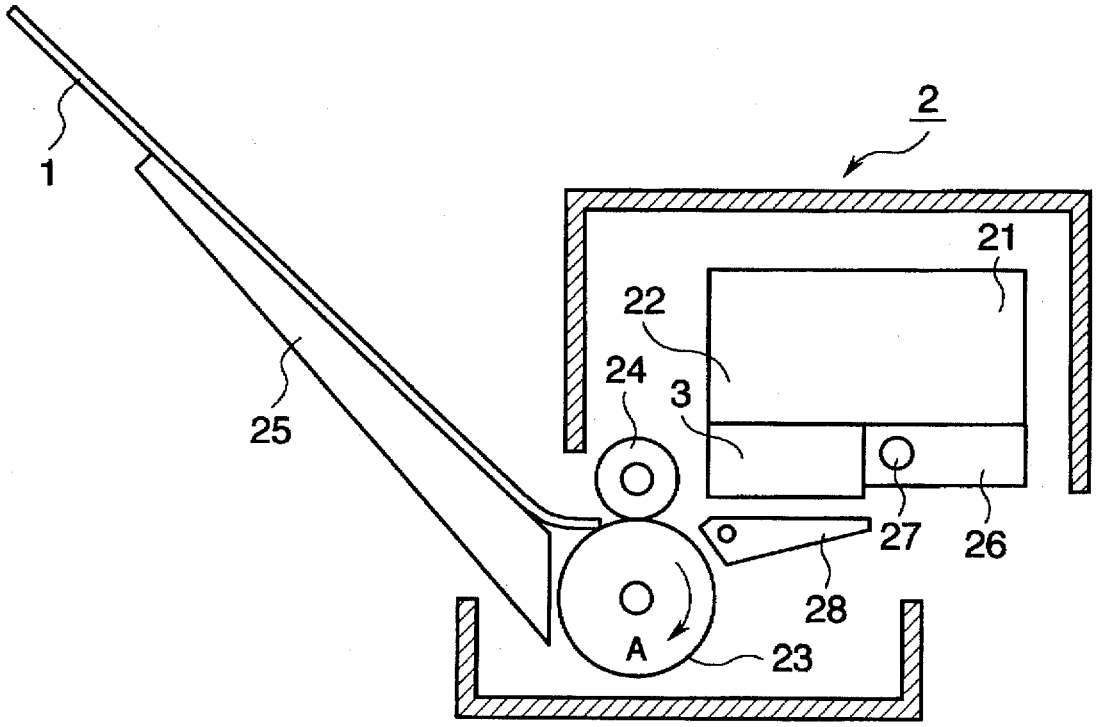
FIG. 4 illustrates the main constitution of an ink-jet leather coloring apparatus used in Example 1.

FIG. 1 diagrammatically illustrates a cross section in thickness direction of a coloring leather prepared by applying the leather treatment for leather coloring according to the present invention. FIG. 4 illustrates the main constitution of a leather coloring means which is one of examples of an ink-jet leather coloring apparatus used to carry out the leather coloring on the coloring leather. The leather treatment process for leather coloring and the leather coloring process will be described in the following, with reference to these drawings.

The leather treatment for leather coloring will be first described with reference to FIG. 1.

As the leather, those prepared through a conventional tanning process may be used. In the present Example, horse hide was used as a raw hide. The hide was subjected to a beamhouse process and thereafter to a tanning process by vegetable tanning to obtain a leather 11 with a thickness of 1 mm.

Next, the grain of this leather was softly washed with methyl ethyl ketone to remove dirt, excess greases and so forth. Thereafter, the treatment to impart the soluble resin and the particle aggregate was carried out. For such treatment, the following treating solution (a) and treating solution (b) were prepared.

Treating solution (a): (treating solution to impart soluble resin)

| | |
|---|---|
| Polyvinyl pyrrolidone | 5% |
| Water | 95% |

Treating solution (b): (treating solution to impart particle aggregate) Styrene/acrylate copolymer, 40% water-based emulsion (nonionic; average particle diameter: 60 μm; minimum

| | |
|---|---|
| filming temperature: 50° C.) | 60% |
| Water | 40% |

First, on the grain of the leather 11, the treating solution (a) was applied by means of a wire bar coater, immediately followed by drying at 40° C. for 1 minute to form a layer 12 comprised of the soluble resin. Next, on this layer, the treating solution (b) was applied by means of a wire bar coater, immediately followed by drying at 40° C. for 30 seconds to form a layer 13 comprised of the particle aggregate in an amount of 2 g/m$^2$. Thus, a leather 1 for coloring was obtained. The coloring leather 1 thus prepared was divided by cutting to have a width corresponding to the long side of A3-size, and thereafter shaped so as to be passable through a leather transport path of the ink-jet leather coloring apparatus.

Leather coloring subsequently carried out on the coloring leather 1 thus obtained will be described with reference to FIG. 4.

The coloring leather 1 having been thus cut was set on the upstream side of the transport direction of paired transport rollers (a transport drive roller 23 and a transport following roller 24) serving as a means for transporting the leather in the ink-jet leather coloring apparatus 2. After the ink-jet leather coloring had been made ready (e.g., treatment to restore the ink-jet head and setting of image data) and the coloring step was started, first the transport drive roller 23 and the transport following roller 24 that follows the former was begun to rotate, and the leather 1 set end-to-end with the transport drive roller 23 was drawn into the pressure contact portion of the paired transport rollers rotating, so that the leather 1 was automatically fitted to the transport means. Then, in synchronization with the transport of the leather 1, an ink-jet leather coloring assembly 22 provided on the transport path was operated to carry out coloring on the leather 1 by an ink jetting in accordance with image data. The colored leather 1 delivered out of the ink-jet leather coloring apparatus 2 after the leather coloring had been completed was air-dried.

The ink-jet leather coloring apparatus 2 used in the present invention is constituted as described below. FIG. 4 illustrates the main part of an example of the constitution of the ink-jet leather coloring apparatus used in the present Example. In FIG. 4, a carriage 26 is mounted with an integral printing head cartridge 22 integrally made up with four ink tanks 21 respectively filled with black, cyan, magenta and yellow four color inks, and four ink-jet printing heads 3 for respectively jetting the four color inks. These ink tanks are filled with inks (A) to (D) shown below.

| Ink (A): | |
|---|---|
| C.I. Food Black 2 (dye) | 3% |
| Thiodiglycol | 10% |
| Ethylene oxide addition product of acetylene glycol | 0.05% |
| Water | Balance |

| Ink (B): | |
|---|---|
| C.I. Acid Blue 9 (dye) | 2.5% |
| Thiodiglycol | 10% |
| Ethylene oxide addition product of acetylene glycol | 0.05% |
| Water | Balance |

| Ink (C): | |
|---|---|
| C.I. Acid Red 289 (dye) | 2.5% |
| Thiodiglycol | 10% |
| Ethylene oxide addition product of acetylene glycol | 0.05% |
| Water | Balance |

| Ink (D): | |
|---|---|
| C.I. Direct Yellow 86 (dye) | 2% |
| Thiodiglycol | 10% |

-continued

| | |
|---|---|
| Ethylene oxide addition product of acetylene glycol | 0.05% |
| Water | Balance |

The inks were each obtained by mixing all the components, and stirring the mixture for 2 hours, followed by filtering under pressure using Fluoropore Filter FP-100 (trade name; available from Sumitomo Electric Industries, Ltd.).

The ink-jet leather coloring apparatus of the present Example is operated as described below. In the present Example, as shown in FIG. 4, in order to stably feed to the ink-jet coloring zone the leather 1 having been cut to the given size, an inclined feed tray 25 is provided so that it is just inserted between the transport drive roller 23 and the transport following roller 24. In this state, as the transport drive roller 23 is rotatingly driven in the direction of an arrow A, the coloring leather 1 is led through the contact pressure portion of the paired transport rollers and successively forwarded to the ink-jet leather coloring zone. The carriage 26 is so designed as to stand by at the home position (not shown), when no ink is jetted or the ink-jet printing head is operated for its restoration.

Before the ink jetting is started, the carriage 26 standing at the position (home position) shown in the drawing is moved along a carriage guide shaft 27 by start command of ink jetting, during which the four color inks are jetted from multiple nozzles of the printing head in accordance with coloring signals while timing on the basis of reading signals of a linear encoder. Thus, inks are jetted in a coloring width s on the coloring surface. With this motion, inks impact on the coloring surface in the order of black ink, cyan ink, magenta ink and yellow ink to form dots which constitute an image. Once this motion has been completed up to a line end of the coloring surface, the carriage 26 is returned to the home position, and the ink jetting is again carried out on a next line.

After this first ink jetting is completed and before the second-time ink jetting is started, the transport drive roller 23 is rotated to transport the leather 1 by the coloring width s. In this way, the ink jetting by the ink-jet printing head in the coloring width s for each scan of the carriage and the transport of leather are repeated until the formation of images on the coloring surface is finished. At the time all the leather coloring has been completed, the colored leather is delivered out by the transport means and at the same time a platen 28 having formed a plane coloring surface during the coloring is inclined in the direction of delivery so that it assists the delivery at the rear end of the apparatus. In order to assist the delivery, a means such as spur rollers may be provided at the downstream side of the leather coloring zone.

Leathers may have thickness in variety depending on the kinds of raw hide or skin and the manners taken in the beamhouse process and tanning process. Hence, it is more effective to provide a mechanism that can variously set the distance between the ink jetting face of the integral printing head cartridge 22 and the platen 28 in accordance with the thicknesses of leathers on which the coloring is being carried out.

Figure 5:
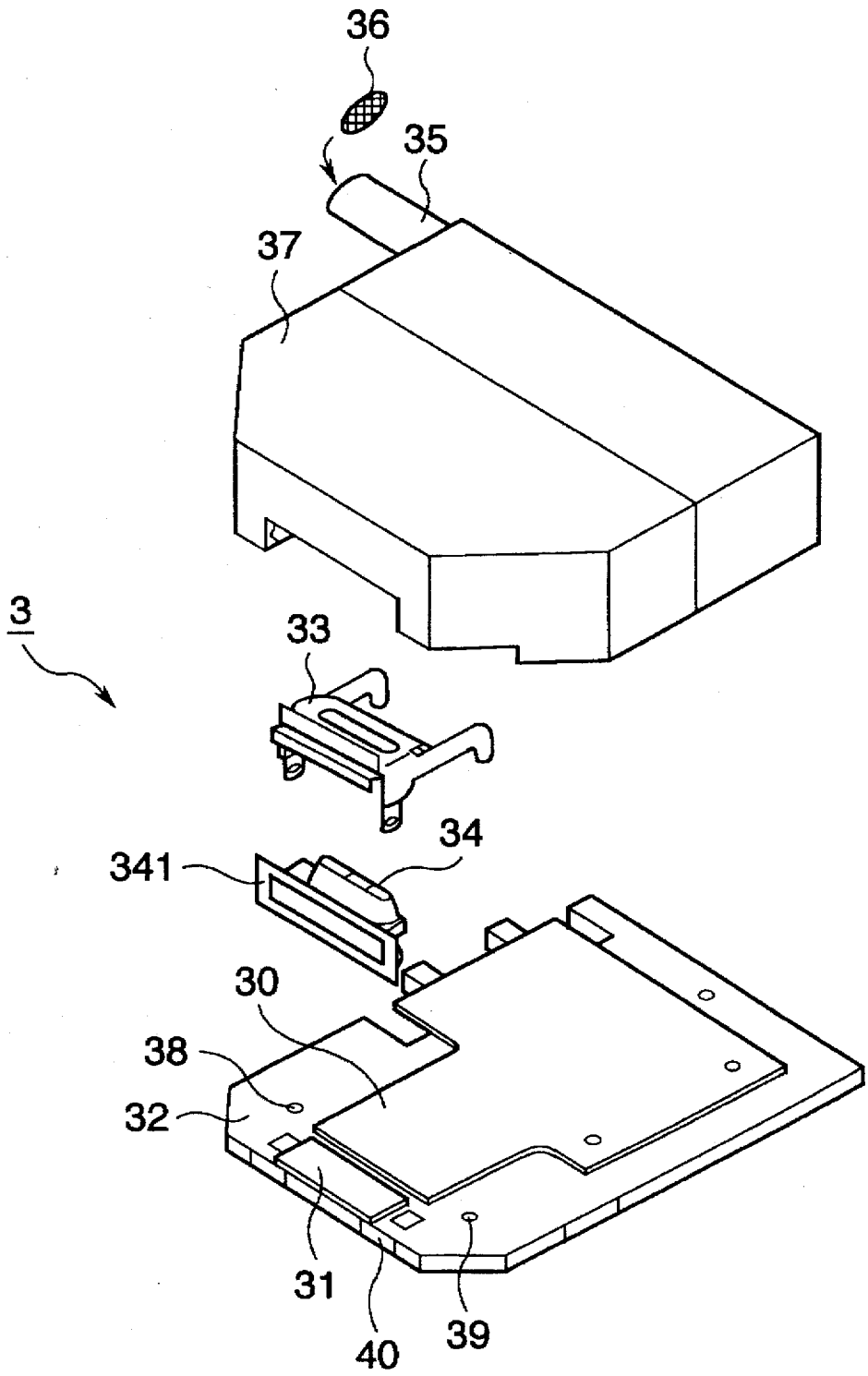
FIG. 5 illustrates the constitution of an ink-jet head applicable in the present invention.

FIG. 5 illustrates the constitution of the ink-jet printing head 3 from which the inks are jetted. One end of a wiring substrate 30 is mutually connected with the wiring portion of a heater board 31. At another end of the wiring substrate 30, a plurality of pads are provided, corresponding with electric energy-heat energy converters for receiving electric signals sent from the main-body apparatus. Thus, the electric signals sent from the main-body apparatus can be supplied to the respective electric energy-heat energy converters. Here, electric energy-heat energy converters are arranged at equal intervals of 360 dpi.

A support 32 made of metal, for supporting the back of the wiring substrate 30 on plane serves as a bottom plate of the ink-jet printing unit. A press spring 33 has i) a member formed to have a bend substantially U-shaped in its cross section in order to linearly elastically press the area in the vicinity of an ink jetting outlet of a grooved top plate 34 for forming nozzles, ii) claws hooked utilizing relief holes provided in the support 32 made of metal, and iii) a pair of rear legs for receiving on the metal support 32 the force acting on the spring. On account of the force of this spring, the wiring substrate 30 is fitted in pressure contact with the grooved top plate 34. To the support, the wiring substrate 30 is fitted by sticking them with an adhesive or the like.

At the end of an ink supply pipe 35, a filter 36 is provided. An ink supply member 37 is made by molding, and the grooved top plate 34 is integrally provided with flow paths leading to an orifice plate 341 and ink supply openings. The ink supply member 37 can be simply fixed to the support 32 by making two pins (not shown) project through two holes 38 and 39, respectively, of the support 32 and thermally fusing them. When they are fixed, the gap between the orifice plate 341 and the ink supply member 37 is sealed and also the gap between the orifice plate 341 and the front end of the support 32 is perfectly sealed through grooves 40 provided in the support 32.

Figure 6:
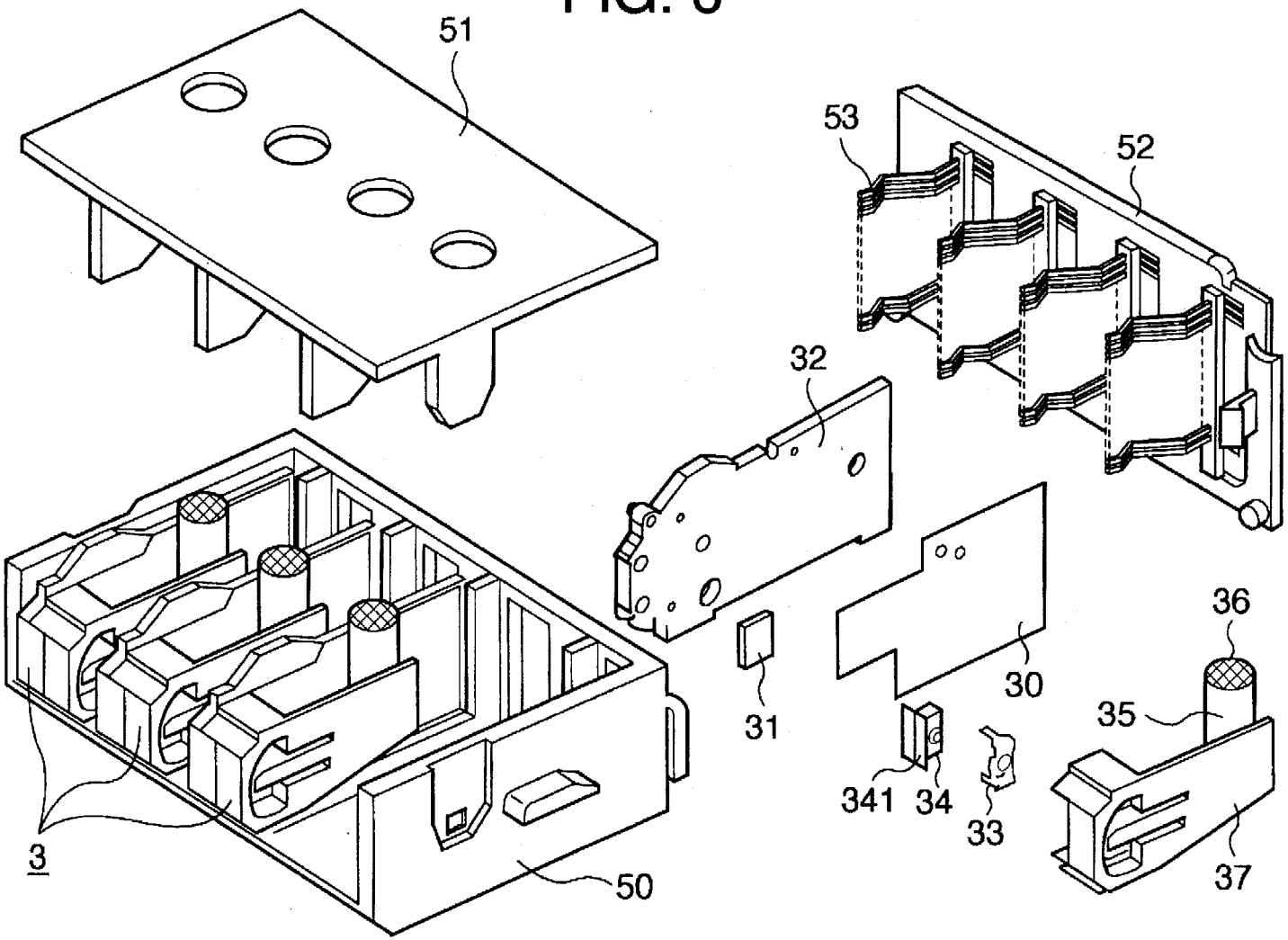
FIG. 6 illustrates the constitution of a color ink-jet head applicable in the present invention.

FIG. 6 shows the structure of a four-head integral ink-jet cartridge 22 in the state that its ink tanks have been removed, where the above four printing heads 3 that can respectively jet the black, cyan, magenta and yellow four inks are integrally assembled with a frame 50. The four ink-jet printing heads are fitted in the frame 50 at given intervals, and also fixed in the state their registration in the nozzle array direction has been adjusted. Reference numeral 51 denotes a cover of the frame; and 53, connecters for connecting the pads provided on the wiring substrate 30 with the electric signals sent form the main-body coloring apparatus. Reference numeral 52 denotes a connecter substrate. Reference numerals 31, 32, 33, 34, 35, 36, 37 and 341 are common to those in FIG. 5.

Figure 2:
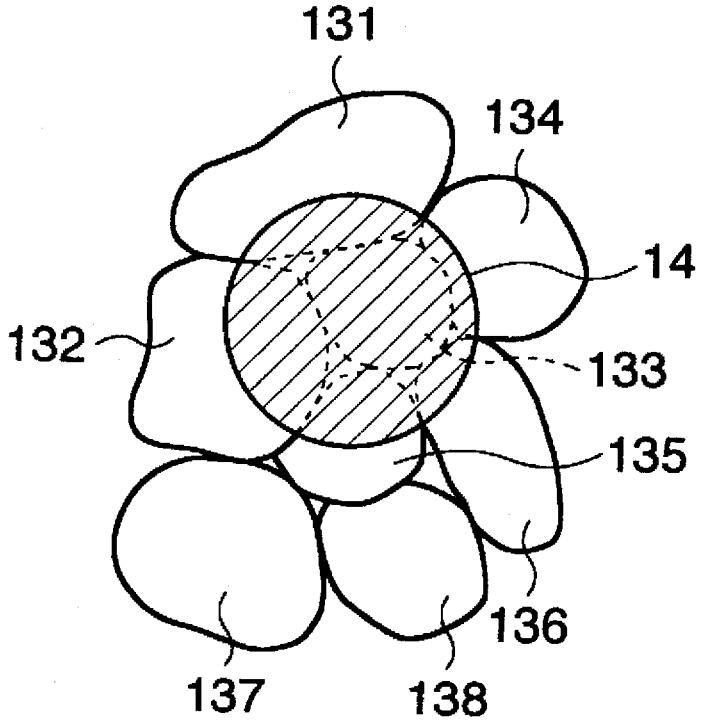
FIG. 2 is a diagrammatic illustration of dots formed when ink droplets are jetted onto the coloring leather of the present invention in Example 1.

The leather coloring is carried out in the manner as described above. Now, the behavior of ink droplets in leather where the ink has reached the coloring leather 1 after jetted from the ink-jet printing head and the action of the soluble resin and particle aggregate having been imparted to the surface of the leather will be described with reference to FIGS. 1 and 2. FIG. 2 is an illustration of the coloring leather 1 viewed from the side of the coloring surface, i.e., an enlarged view of a representative portion viewed from the direction V shown in FIG. 1. In the example illustrated, the soluble resin and the particle aggregate each form a layer, and hence, when the coloring leather 1 is viewed from the direction V, particles 131 to 138 of the outermost surface layer are seen as shown in FIG. 2. Once ink droplets are jetted by the ink-jet leather coloring apparatus and have reached this coloring leather 1, each ink droplet forms a dot 14 on the surface of the particle aggregate and thereafter further permeates into the leather 1 in substantially the same direction as its thickness direction.

As shown in FIG. 2, the relationship in size between the diameter of the dot 14 formed of an ink droplet and the diameters of the respective particles 131 to 138 having come into contact therewith is so designed that the diameter of the dot 14 is largest at all locations. In this example, the particles have an average particle diameter of 50 μm, and the dot 14 a diameter of 90 μm, the former being smaller than the latter as previously described. Thus, the permeation of the ink droplets can proceed without being blocked by the particle aggregate. Since the particles also comprised of a styrene-acrylate copolymer have been originally nonionic emulsion particles, the part coming into contact with ink droplets has an affinity for ink and has non-dyeable properties on account of the action of the hydrophilic groups. The ink having subsequently permeated comes into contact with the soluble resin 12 comprised of polyvinyl pyrrolidone. Since this resin is water-soluble, it is dissolved on account of water contained in the ink, to become viscous and at the same time causes a decrease in the viscosity of this layer itself, so that it enters the gaps between the particle aggregate 13 in part and at the same time enters the inside of the leather 11 in part. As a result, the respective particles in the particle aggregate 13 are more firmly held than inside the coloring leather 1. Then the ink further permeates until it reaches the inside of the leather 11, so that sharp coloring is accomplished.

The images formed by leather coloring in the manner as described above were very sharp, and were in a quality comparable to images conventionally obtained on paper. It was also possible to shorten the time taken for the leather coloring, compared with that taken in conventional dyeing methods. No deterioration of images occurred when the colored leather was further subjected to finishing steps such as coating, setting out, trimming and glazing. Also, no handle of leather was damaged since the soluble resin and particle aggregate imparted to the leather were in small quantities. Hence, thereafter it was possible to process the leather according to various uses to obtain leather articles.

EXAMPLE 2

The leather 1 processed through the leather coloring in Example 1 was put in a thermostatic chamber conditioned at 60° C. to apply heat treatment for 2 minutes. The coloring leather having been thus heated was left to stand for 12 hours in a thermostatic chamber with an environment of 35° C. and 95%RH, and thereafter taken out of the thermostatic chamber. The leather taken out had caused no deterioration of leather-colored images at all even after being exposed to such a high temperature and made to gain water content. Of course, it caused no deterioration of images also when external force such as a bend of leather or a rub on colored surface was applied. Thus, thereafter the leather was able to be passed through finishing steps and processed into leather articles.

EXAMPLE 3

Figure 3:
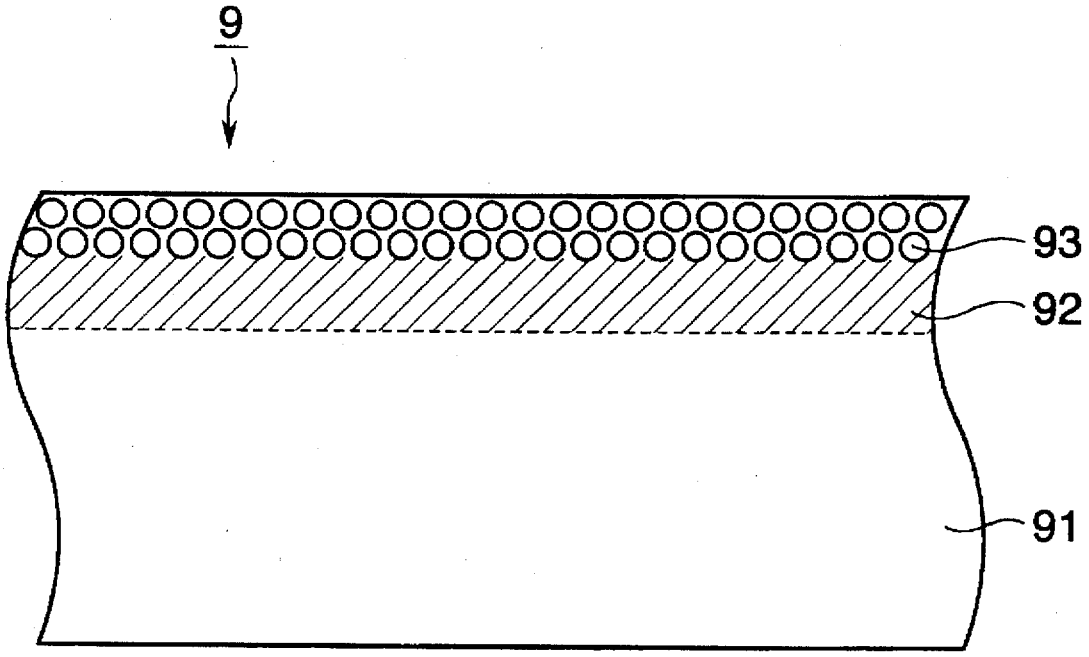
FIG. 3 is a cross section in thickness direction to diagrammatically illustrate the constitution of the coloring leather of the present invention in Example 3.
Figure 7:
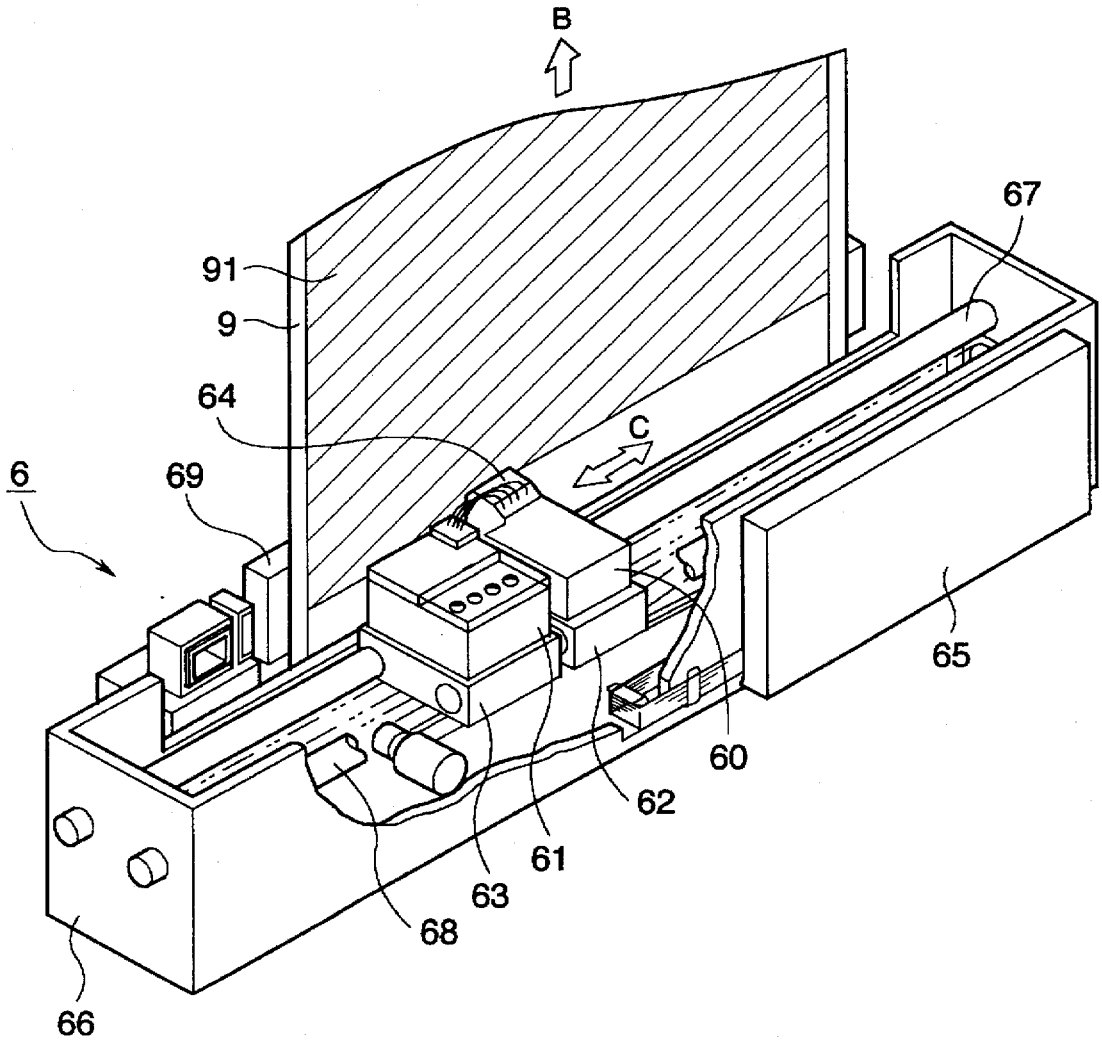
FIG. 7 illustrates the main constitution of an ink-jet leather coloring apparatus used in Example 3.

FIG. 3 diagrammatically illustrates another state where the leather treatment for leather coloring according to the present invention has been applied to a leather. FIG. 7 illustrates the main constitution of another example of the ink-jet leather coloring apparatus for carrying out leather coloring on the leather having been treated for leather coloring as shown in FIG. 3. The leather and the leather coloring process according to the present Example will be described in the following, with reference to FIGS. 3 and 7.

Here, using bovine hide as a raw hide, the hide is subjected to a beamhouse process and then chrome tanning in the same manner as in Example 1. Since, however, the leather obtained is a little bluish, the leather is subsequently subjected to depickling neutralization and further to bleaching with a bleacher comprising synthetic tannin, to obtain a leather 91 of 2 mm thick. On the leather 91 thus obtained, the soluble resin and the particle aggregate are imparted using treating solutions (c) and (d) respectively prepared to have the following composition. Treating solution (c): (treating solution to impart soluble resin)

| | |
|---|---|
| Polyvinyl alcohol | 2% |
| Water | 98% |

Treating solution (d): (treating solution to impart particle aggregate) Vinyl acetate/acrylate copolymer resin, 35% water-based emulsion (nonionic; average particle diameter:

| | |
|---|---|
| 40 μm; minimum filming temperature: 100° C.) | 70% |
| Water | 30% |

To apply the treatment, first the treating solution (c) is sprayed over the grain surface of the leather by means of a spray gun, followed by drying at 50° C. for 1 minute to provide a soluble resin treatment 92, imparted in an amount of 0.8 g/m$^2$. Next, the treating solution (d) is sprayed thereon by means of a spray gun, followed by drying at 50° C. for 1 minute to provide a particle aggregate treatment 93, imparted in an amount of 1.5 g/m$^2$. Thus, a coloring leather 9 is obtained. In this coloring leather 9, the soluble resin and the particle aggregate are in such a form that they have almost permeated through the surface portion in the inside of the leather 91. On the coloring leather 91 thus prepared, leather coloring is carried out using the ink-jet leather coloring apparatus as shown in FIG. 7.

Inks used in this leather coloring are the following inks (E) to (H).

| Ink (E): | |
|---|---|
| C.I. Reactive Black 5 (reactive dye) | 13% |
| Thiodiglycol | 15% |
| Diethylene glycol | 15% |
| Calcium chloride | 0.002% |
| Water | Balance |

| Ink (F): | |
|---|---|
| C.I. Reactive Blue 72 (reactive dye) | 13% |
| Thiodiglycol | 25% |
| Triethylene glycol monomethyl ether | 4% |
| Water | Balance |

| Ink (G): | |
|---|---|
| C.I. Reactive Red 24 (reactive dye) | 10% |
| Thiodiglycol | 16% |
| Diethylene glycol | 10% |
| Tetraethylene glycol dimethyl ether | 4% |
| Water | Balance |

| Ink (H): | |
|---|---|
| C.I. Reactive Yellow 95 (reactive dye) | 10% |
| Thiodiglycol | 26% |
| Diethylene glycol | 9% |
| Water | Balance |

These inks are also obtained by pressure filtering in the same manner as the inks used in Example 1.

The ink-jet leather coloring apparatus shown in FIG. 7 is operated as described below. This apparatus shows an example of an apparatus that makes it unnecessary to cut the leather in a standard size. Leathers have different size depending on the kinds of starting raw hide or skin and the individuals, and, even after going through the tanning process, they usually have a larger area than the A3-size as noted in Example 1. Now, in the present Example, an ink-jet leather coloring apparatus 6 that can carry out leather coloring without regard to the size of the leather is provided.

In the apparatus shown in FIG. 7, the basic operation for leather coloring is the same as that in the leather coloring apparatus described in Example 1, except that a large-sized ink-jet printing head 60 having a number of nozzles in a density of 360 dpi and a large-sized ink supplying assembly 61 so designed that inks can be fed in large quantities are provided on a carriage 62 and a carriage 63, respectively, in the ink-jet leather coloring zone in order to make the apparatus adaptable to the size of leathers having been tanned. These carriages are connected through a tube 64 so that the inks are supplied to the ink-jet printing head 60 from the ink supplying assembly 61 loaded with the inks (E) to (H) in its chambers partitioned for the respective inks. According to signals sent from a transmitter 65 to the ink-jet printing head 60, the two carriages are reciprocatingly moved to scan in the directions of arrows C shown in the drawing, along a guide rail 67 and a guide rail 68, respectively, fitted to a frame 66, and at the same time the jetting of inks from the ink-jet printing head 60 in accordance with image signals is started, and thus leather coloring can be made on the coloring leather 9.

Leather coloring carried out using this ink-jet leather coloring apparatus is operated as described below.

First, one end of the back of the coloring leather 9 is set fittingly to a platen 69 (its fitting portion is now shown). Thereafter, ink-jet timing signals for each nozzle of the ink-jet printing head are produced from image signals supplied to the transmitter 65 from an image signal generator separately provided, and inks for coloring are jetted to the leather 9. Then, every time the ink-jet printing head has scanned once, the leather is moved in the direction of an arrow B by the width the leather coloring has been thus carried out. With subsequent repetition of this motion, colored areas 91 successively appear on the coloring leather 9, and finally extend over the whole surface of the coloring leather 9, where the leather coloring is completed.

Leathers coming out of the tanning process are not uniform in shape, and also their edges are not formed in straight lines. Thus, if the leather is passed as it is, through the ink-jet leather coloring apparatus shown in FIG. 7, the ink to form images may be jetted outside the leather face. As a result, it follows that the inks are jetted onto the platen 69 to contaminate the surface of the platen. If such a phenomenon occurs, the back of the coloring surface may be stained when a next leather is passed to carry out subsequent leather coloring, or the inks jetted on the platen become dry and may form deposits thereon to hinder a smooth movement of leather on the platen, causing a faulty transport of the leather.

In order to prevent such difficulties, a sheet of paper coated with an adhesive readily separable after the leather coloring has been completed may be stuck to the non-coloring surface, i.e., the flesh side here, of a leather before the leather is set on the ink-jet leather coloring apparatus. It is also effective to add processing such that the ends of a leather on the platen are detected at every scan of the carriage during the operation of leather coloring so that the image data are deleted from its portions extending out of the edges.

The leather 9 gone through the leather coloring is subsequently further subjected to a treatment to spray a base coating material prepared using a water-based emulsion of polyamide, by means of a spray gun on the whole coloring surface, followed by drying at 60° C., and then coated with a lacquer to give the finishing. The leather obtained is further cut and stitched so as to be processed into a leather article.

According to the example described above, it is unnecessary to cut leather in standard size after tanning, so that multi-color image formation can be accomplished with ease in the size of leather materials usually circulated in the market and also the leather coloring step can be made more efficient and rapid. It is also possible to treat leathers in free form. Moreover, in the case of the leathers having a large area, it is difficult to avoid rolling up or folding them. However, even when such mechanical external force is applied, no deterioration of images may occur when the coloring leather according to the present invention is used.

EXAMPLE 4

The leather 9 just gone through the leather coloring in Example 3 was passed through an automatic ironing roller machine conditioned at 120° C., to apply heat treatment for 30 seconds. The coloring leather having been thus heated was, as in Example 2, left to stand for 12 hours in a thermostatic chamber with an environment of 35° C. and 95%RH, and thereafter taken out of the thermostatic chamber. The leather taken out was able to keep colored images having a sense of gloss even after exposed to such a high temperature and made to gain water content. Of course, the leather caused no deterioration of images also when external force such as a bend of leather or a rub on colored surface was applied. Thus, thereafter the leather was able to be passed through finishing steps and processed into leather articles. Moreover, since in this case the leather was heated in a short time on the automatic ironing roller machine conventionally used in the leather manufacture, it was also possible to make the process more efficient.

EXAMPLE 5

As still another state where the leather treatment for leather coloring according to the present invention has been applied to a leather, there can be an instance where the soluble resin permeates into the leather and the particle aggregate forms a layer. This can be made up using the treating solution (c) used in Example 3 and the treating solution (b) used in Example 1.

In the present Example, using the same horse hide as used in Example 1, the leather treatment for leather coloring is applied on the flesh side thereof. First the treating solution (c) is sprayed by means of a spray gun, followed by drying at 50° C. for 1 minute to provide a soluble resin treatment, imparted in an amount of 0.8 g/m$^2$. Next, the treating solution (b) is sprayed thereon by means of a spray gun, followed by drying at 40° C. for 30 seconds to provide a particle aggregate treatment, imparted in an amount of 1.5 g/m$^2$. Thus, a coloring leather is obtained. On the coloring leather thus prepared, leather coloring is carried out using the ink-jet leather coloring apparatus as shown in FIG. 7. As a result, leather-colored images with a high quality level is also obtained and cause no problem of image deterioration when the finishing process was performed. This mode is advantageous when the leather coloring is carried out on the flesh side having a relatively low surface smoothness.

The present invention has been described in greater detail by giving Examples. In these Examples, the leather coloring carried out by the ink-jet coloring system has been described. The same advantage of the present invention can also be obtained by methods making use of paintbrushes or stencils so long as liquid inks are used.

Finally, the ink-jet coloring system which is a very effective means for the leather coloring process according to the present invention will be additionally described below.

In the ink-jet coloring system used in the present invention, images are constituted of dots densely divided into 300 dpi, 360 dpi or much more 600 dpi, and inks corresponding to these individual dots are caused to impact against the coloring surface, in the form of droplets jetted from minute nozzles. Hence, leather coloring per dot can be carried out and sharp images can be formed in a uniform color tone. Also, since the ink-jet coloring system is a system to carry out coloring in non-contact with the medium, it is not always necessary to keep strict uniformity in the smoothness of the surface of leather and in the support on the back of leather, and also plural colors of droplets can be jetted in one step, so that multi-color images can be formed in a short time.

In the ink-jet coloring system, a plurality of nozzle arrays for ink jetting are moved in a relative fashion with respect to the leather at the same time with the ink jetting, where the dot density can be made higher and the sharpness of colored areas can be improved. Thus, the images or marks in monochromes or composite colors to be formed by ink jetting can be formed in specific colors only in specific partial areas on the leather surface, and hence the partial specific areas can be formed as emphasized areas or color-softened areas. In reverse, the leather treatment for leather coloring previously described may be applied only to the partial specific areas using a mask or the like, whereby the ink-jet leather-colored areas can be more emphasized.

As an additional advantage in the ink-jet leather coloring on the leather surface, even when non-smooth portions such as follicle mouths and wrinkles are present on the leather surface, the quantity of ink jet can be controlled only at those portions so that neither non-uniform coloring nor non-coloring may occur in relation to other portions (smooth portions or peripheral areas). If, on the other hand, the grain surface is uniform, the quantity of ink to be jetted can be adjusted or changed by programming or by image processing on a host computer of the system, whereby the desired density distribution or gradation can be obtained and the images can be represented in variety.

When inks are imparted by the ink-jet recording system using conventional paper, the maximum shot-in ink quantity is limited in view of decrease in resolution, bleeding (between colors), strike-through, increase in fixing time and so forth. Hence, in usual instances, the maximum shot-in ink quantity is commonly so designed as to be within the range of from 16 to 28 nl/mm$^2$ in the case of water-based inks. However, in the case of the leather coloring process of the present invention, it is possible to impart ink in a larger quantity, depending on the state in which the soluble resin and the particle aggregate are imparted. Numerically stated, the shot-in ink quantity can be twice or more than usual cases, i.e., about 16 to 50 nl/mm$^2$. In particular, high-density leather coloring can be carried out at a lower coloring speed than the ink-jet printing head scanning speed corresponding to the frequency in the leather coloring, for example, double-density coloring can be carried out at a scanning speed of ½ or the same colored areas can be superimposed by scanning several times, so that the images can be represented in variety.

As the ink-jet coloring system itself, there are various systems, chiefly including a charge control type, a jet system using a piezoelectric device, and a jet system using an exothermic device. Among these, the jet system using an exothermic device as also used in Examples is preferable since the ink-jet printing head can be assembled in a high density, and can obtain images of a higher quality.

As described above, the present invention has made it possible to provide the leather treatment process for leather coloring, and the leather coloring process, that easily enables stable image representation on leather which has been hitherto difficult in some points. Thus, it has also become possible to efficiently form high-quality images including pictures with light and shade and pictures with multiple colors. Also, a high image reliability can be achieved without any restriction to the finishing process carried out after the leather coloring. These processes make it possible to manufacture many kinds of products in small quantities and also to meet detailed demands in the market.

What is claimed is:

1. A leather coloring process comprising jetting a liquid ink to onto leather in the form of ink droplets, the ink comprising a coloring material dissolved or dispersed in an appropriate solvent, said leather comprising a leather which has been treated by imparting to a coloring surface of said leather a resin soluble in said liquid ink and an aggregate of particles with a functional group having an affinity for said liquid ink, wherein the diameter of each of the particles in said aggregate of particles is smaller than the diameter of dots formed by the ink droplets.

2. The leather coloring process according to claim 1, wherein said soluble resin is allowed to permeate into said leather from its coloring surface.

3. The leather coloring process according to claim 1, wherein at least one of said soluble resins and said aggregate of particles is formed into a layer on the coloring surface of said leather.

4. The leather coloring process according to claim 1, wherein said soluble resin and said aggregate of particles are each imparted in an amount of not less than 0.01 $g/m^2$ to not more than 10 $g/m^2$ of the leather.

5. The leather coloring process according to claim 1, wherein said soluble resin is rendered viscous upon dissolution in said liquid ink.

6. The leather coloring process according to claim 1, wherein said aggregate of particles forms a surface where particles are arranged along the coloring surface of said leather.

7. The leather coloring process according to claim 6, wherein said aggregate of particles comprises an aggregate of particles of an emulsion prepared by emulsifying a liquid component of the same kind as that of said liquid ink.

8. The leather coloring process according to claim 7, wherein said leather coloring process and treatment of the leather with said soluble resin and aggregate of particles is performed at a leather-coloring treatment temperature, and wherein said emulsion has a minimum filming temperature which is higher than said leather coloring-treatment temperature.

9. The leather coloring process according to claim 2, wherein said soluble resin and said aggregate of particles are non-dyeable.

10. The leather coloring process according to claim 2, wherein a coloring material in said liquid ink has been dissolved or dispersed in water.

* * * * *

UNITED STATES PATENT AND TRADEMARK OFFICE

CERTIFICATE OF CORRECTION

PATENT NO. : 5,676,707

DATED : October 14, 1997

INVENTOR(S) : NOBUYUKI KUWABARA, ET AL.

It is certified that error appears in the above-identified patent and that said Letters Patent is hereby corrected as shown below:

On the title page, item:

[56] REFERENCES CITED

U.S. PATENT DOCUMENTS

"1/1934" should read --1/1932--.

COLUMN 1

Line 19, "It still" should read --It--.

COLUMN 5

Line 28, "become not well" should read --not become--.

COLUMN 8

Line 48, "adhere" should read --to adhere to--.

COLUMN 9

Line 4, "to high" should read --too high a--.

COLUMN 10

Lines 55-57 "Styrene/acrylate ... 60 μm; minimum" should be deleted; and
Line 59, "filming temperature:" should read --Styrene/acrylate copolymer, 40% water-based emulsion (nonionic; average particle diameter: 60 μm; minimum filming temperature:--.

UNITED STATES PATENT AND TRADEMARK OFFICE

CERTIFICATE OF CORRECTION

PATENT NO. : 5,676,707

DATED : October 14, 1997

INVENTOR(S) : NOBUYUKI KUWABARA, ET AL.

It is certified that error appears in the above-identified patent and that said Letters Patent is hereby corrected as shown below:

COLUMN 13

Line 42, "form" should read --from--; and
Line 48, "jetted" should read --being jetted--.

COLUMN 15

Line 6, "composition. Treating" should read --composition. ¶ Treating--;
Lines 14-15 "Vinyl acetate/acrylate ... particle diameter:" should be deleted;
Line 18, "40 μm;" should read --Vinyl acetate/acrylate copolymer resin, 35% water-based emulsion (nonionic; average particle diameter: 40 μm;--; and
Line 32, "91" (second occurrence) should read --9--.

COLUMN 17

Line 29, "exposed" should read --being exposed--.

UNITED STATES PATENT AND TRADEMARK OFFICE

CERTIFICATE OF CORRECTION

PATENT NO. : 5,676,707

DATED : October 14, 1997

INVENTOR(S) : NOBUYUKI KUWABARA, ET AL.

It is certified that error appears in the above-identified patent and that said Letters Patent is hereby corrected as shown below:

COLUMN 19

Line 5, "Examples" should read --the Examples--; and
Line 22, "ink to onto" should read --ink onto--.

COLUMN 20

Line 25, "leather coloring-treatment" should read --leather-coloring treatment--.

Signed and Sealed this

Sixteenth Day of June, 1998

*Attest:*

*Attesting Officer*

Bruce Lehman

BRUCE LEHMAN

*Commissioner of Patents and Trademarks*